US006915093B2

(12) United States Patent
Hatakeyama

(10) Patent No.: US 6,915,093 B2
(45) Date of Patent: Jul. 5, 2005

(54) IMAGE FORMING APPARATUS HAVING A GUIDE DEVICE FOR GUIDING A BRUSH ROLLER

(75) Inventor: Takashi Hatakeyama, Yokohama (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 72 days.

(21) Appl. No.: 10/383,676

(22) Filed: Mar. 10, 2003

(65) Prior Publication Data

US 2004/0179863 A1 Sep. 16, 2004

(51) Int. Cl.[7] ..... G03G 15/02
(52) U.S. Cl. ..... 399/175; 399/107
(58) Field of Search ..... 399/107, 111, 399/115, 168, 174, 175

(56) References Cited

U.S. PATENT DOCUMENTS 5,754,926 A * 5/1998 Sakuraba ..... 399/175
6,038,415 A * 3/2000 Nishi et al. ..... 399/111
6,173,142 B1 * 1/2001 Kawakami ..... 399/175
6,505,021 B2 * 1/2003 Shibuya et al. ..... 399/149

FOREIGN PATENT DOCUMENTS

| | | | |
|---|---|---|---|
| JP | 63-210862 | A | 9/1988 |
| JP | 1-231074 | A | 9/1989 |
| JP | 3017201 | A | 12/1999 |

* cited by examiner

*Primary Examiner*—Hoan Tran
(74) *Attorney, Agent, or Firm*—Foley & Lardner LLP

(57) ABSTRACT

An image forming apparatus includes a charging device that, by allowing a brush roller to be rotated so as to be set in contact with a surface of a photosensitive body, charge the surface of an image carrier, a light exposure device that radiates image information light onto the surface of the image carrier to form an electrostatic latent image, a developing device that develops the electrostatic latent image into a developing agent image, a transfer device that transfers the developing agent to a sheet, and a guide device that guides an outer periphery of the brush roller so as to prevent the image information light from being blocked by the brush roller.

11 Claims, 5 Drawing Sheets

IMAGE FORMING APPARATUS HAVING A GUIDE DEVICE FOR GUIDING A BRUSH ROLLER

BACKGROUND OF THE INVENTION

The present invention relates to an image forming apparatus used, for example, in an electrophotographic copying machine.

As this type of image forming apparatus, an apparatus as shown, for example, in FIG. 11 is known. That is, reference numeral 101 denotes a drum-like photosensitive body which is rotatable as an image carrier. Around the circumference of the photo-sensitive drum 101, a charging brush roller 102, a developing device 104, a transfer roller 105, a cleaning device 106 and a charge eliminator 107 are arranged along a rotation direction (indicated by an arrow) of the photosensitive drum.

At a time of forming an image, the surface of the photosensitive drum is uniformly charged by the rotation of the charging brush roller 102. Image information light 109 is radiated onto the charged surface of the photosensitive drum 101 by means of a light exposure device, not shown, to form an electro-static latent image there. The electrostatic latent image is sent by the rotation of the photosensitive drum 101 to a position where it faces the developing device 104 and is then developed by being supplied with a toner from the developing device 104. In this way, a toner image is created there. The toner image is electrostatically transferred by the transfer roller 105 to a conveying sheet P. The sheet having the transferred toner image is heated/pressed by a fixing unit, not shown, to allow the image to be fixed to the sheet and a given image to be formed there.

After the toner image has been transferred to the sheet, residual toner on the photosensitive drum 101 is cleaned off by the cleaning device 106. After the cleaning step, the surface of the photosensitive drum 1 is discharged by the charge eliminator 107.

In recent years, there has been a tendency toward more compact image forming apparatuses and not only the photosensitive drum 101 but also the surrounding mechanisms (developing device 104, cleaning device 106, charge eliminator, etc.) have been made more compact. Further, the distance between the respective mechanisms has been reduced and there is a growing demand that the charging section also be made more compact. If the charging section is made smaller, then there arises charging failure.

If, for example, charging is made by the charging brush roller 102 and, in this case, the roller diameter is made smaller, then the surface area becomes smaller and the brushing amount involved is decreased. As a result, less contact is involved between the brush and the photosensitive drum 101, so that there arises a charging failure. In order to maintain a better charging level, it is essential to secure an adequate roller diameter.

In order to secure an adequate diameter of the charging brush roller 102, however, it becomes necessary that the distance L between the center of the charging brush roller 102 and the image information light 109 be made greater. That is, unless the distance L is made more than one half the diameter of the charging brush roller 102, the outer peripheral portion of the brush 102*a* blocks out the image information light 109, so that it is not possible to give exposure light.

In the case where a charging roller 102 of a greater outer diameter is used, the distance L becomes greater and there is the inconvenience that it is not possible to provide a compact apparatus.

BRIEF SUMMARY OF THE INVENTION

The present invention has been achieved with the above in view and the object of the present invention is to provide an image forming apparatus which, even if a charging brush roller of a greater diameter is used, can decrease the distance between the center of the charging brush roller and image information light.

In one aspect of the present invention, there is provided an image forming apparatus comprising a charging device configured to, by allowing a brush roller to be rotated in such a state as to be set in contact with the surface of the image carrier, charge the surface of the image carrier; a light exposure device configured to radiate image information light onto the surface of the image carrier charged by the charging device and form an electrostatic latent image; a developing device configured to develop the electrostatic latent image which is formed by the exposure device into a developing agent image; a transfer device configured to transfer the developing agent image which is developed by the developing device onto a to-be-transferred medium; and a guide device configured to guide an outer periphery of the brush roller so as to prevent the image information light which is directed toward the image carrier from being blocked by the brush roller of the charging device.

In another aspect of the present invention there is provided an image forming apparatus comprising a charging device configured to, by allowing a brush roller to be rotated in such a state as to be set in contact with a surface of the image carrier, charge the surface of the image carrier; a light exposure device configured to radiate image information light onto the surface of the image carrier charged by the charging device and, by doing so, form an electrostatic latent image; a developing device configured to develop the electrostatic latent image which is formed by the light exposure device into a developing agent image; a transfer device configured to transfer the developing agent image which is developed by the developing device onto a to-be-transferred medium; a guide device configured to guide an outer periphery of the brush roller so as to prevent the image information light which is directed toward the image carrier from being blocked by the brush roller of the charging device; and a moving device configured to move the brush roller of the charging device toward and away from the guide device and image carrier.

In another aspect of the present invention there is provided an image forming apparatus comprising a charging device configured to, by allowing a brush roller to be rotated in a such a state as to be set in contact with a surface of an image carrier, charge the surface of the image carrier; a light exposure device configured to radiate image information light onto the surface of the image carrier charged by the charging device and form an electrostatic latent image; a developing device configured to develop the electrostatic latent image which is developed by the light exposure device into a developing agent image; a transfer device configured to transfer the developing agent image developed by the developing device onto a to-be-transferred medium; an charge eliminating device set to a position contacting with the brush roller of the charging device and configured to, after the developing agent image has been transferred by the transfer device onto the medium, discharge the surface of the image carrier; and a guide device configured to guide an outer periphery of the brush roller so as to prevent image information which is radiated from the light exposure device from being blocked by the brush roller of the charging device.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The embodiment of the present invention will be described below with reference to the accompanying drawing.

Figure 1:
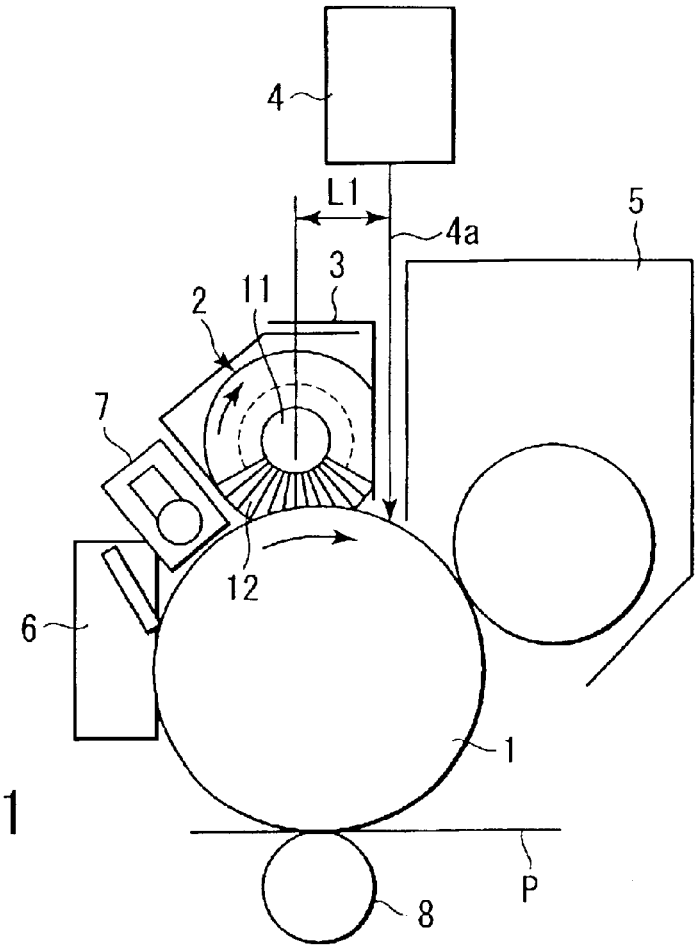
FIG. 1 is an inner schematic view showing an electrophotographic copying machine according to a first embodiment of the present invention.

FIG. 1 is a schematic view showing peripheral devices for a photosensitive drum of an electrophotographic copying machine as an image forming apparatus according to a first embodiment of the present invention.

In FIG. 1, reference numeral 1 shows a drum-like photosensitive body which is rotatable as an image carrier. Around the circumference of the photosensitive body 1, a charging brush roller 2 as a charging device, a guide member 3 as a guide device, a light exposure device 4, a developing device 5, a transfer roller 8, a cleaning device 6 and a charge eliminator 7 are arranged along a rotation direction (indicated as an arrow) of a photosensitive body.

The charging brush roller 2 is used to charge the surface of the photosensitive body 1 and the guide member 3 is used to guide an outer periphery of a brush 12 of the charging brush roller 2. The light exposure device 4 is used to radiate image information light 4*a* onto the surface of the photosensitive body 1. The developing device 5 is used to develop an electrostatic latent image. The transfer roller 8 is used to transfer a toner image on the photosensitive body 1 to a sheet P. The cleaning device 6 is used to remove residual toner on the photosensitive body 1 and the charge eliminator 7 is used to discharge the surface of the photosensitive body 1.

The charging brush roller 2 and photosensitive body 1 are rotated in a direction as indicated by an arrow, that is, rotated in an "against" direction. The peripheral speed ratio between the charging brush roller 2 and the photosensitive body 1 is preferably set to 0.5 to 3 times, and here two times, in order to achieve better charging. In the case where the charging brush roller 2 and photosensitive body 1 are rotated in a "with" direction, their peripheral speed ratio is preferably set to 1.1 to 4 times.

Now an image forming operation will be explained below.

When a copy button, not shown, is pushed, then the surface of the photosensitive body 1 is uniformly charged by the rotation of the charging brush roller 2. Image information light 4*a* corresponding to an image is radiated by the light exposure device 4 onto the surface of the photosensitive body 1 to form an electrostatic latent image on the photosensitive body 1. By the rotation of the photosensitive body 1, the electrostatic latent image is sent to a position opposite the developing device 5. Toner is supplied from the developing device 5 to form a toner image on the photosensitive body 1. By the rotation of the photosensitive body 1, the toner image is moved toward the transfer roller 8 where the image is electrostatically transferred by the transfer roller 8 to a conveying sheet P. The toner image-transferred sheet P is conveyed to a fixing device (not shown) where the sheet is heated/pressed to allow the toner image to be fixed to the sheet P and a predetermined image to be formed on the sheet.

After the toner image has been transferred, residual toner on the photosensitive body is cleaned off by the cleaning device 6 and, after the cleaning step, the surface of the photosensitive body 1 is discharged by the charge eliminator 7.

It is to be noted that the guide member 3 is formed of a metal sheet, such as a steel sheet, SUS and aluminum, or a resin, such as ABS and polyethylene. In the case where the guide member 3 is made of the metal sheet, an insulating surface treatment may be performed on its contact surface of the charging brush roller 2 so as to prevent any electric shock. For example, a special insulating and wear-resistant surface treatment such as Tough Ram treatment is applied to aluminum.

There is a danger that, depending upon the type of toner, the toner may be deposited on the guide member 3. If this is the case, the Teflon sheet of a better separation property, etc., may be either bonded to or coated on the surface of contact with the charging brush roller 2 so as to prevent the toner from being deposited on the guide member.

Further, the distance between the guide member 3 and the image information light 4*a* may be set to over 1 mm because, if the distance is too narrow, it is necessary to mount the guide member 3 or any associated component part of an accurate finish.

Figure 3:
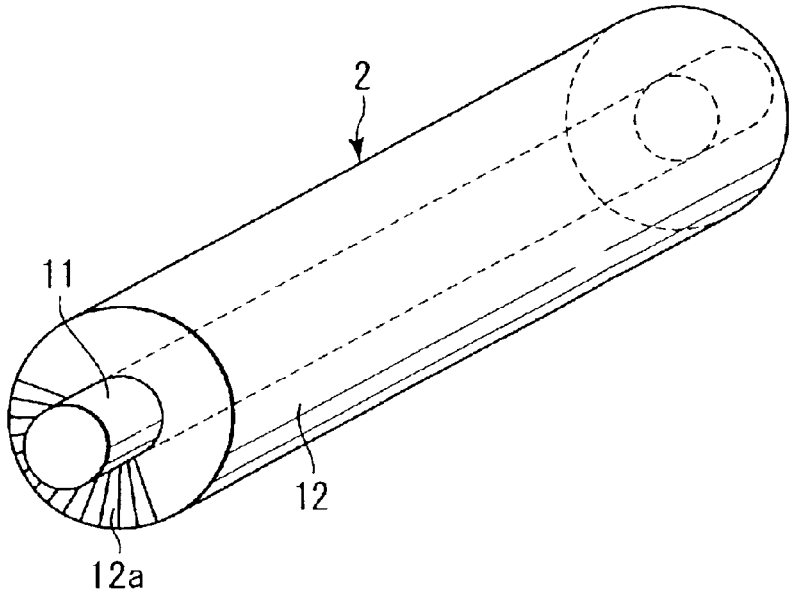
FIG. 3 is a perspective view showing the charging brush roller in FIG. 1.

The charging brush roller 2 comprises a shaft 11 and a brush 12 as shown in FIG. 3 and has an outer diameter of 12 mm to 20 mm to secure a smaller dimension.

The bristles 12*a* of the brush 12 comprise a conductive-fiber-equipped cloth which is spirally wound on the shaft 11 without any gap. The diameter of the shaft 11 is set to be 5 mm to 10 mm taking its flexible nature, etc., into consideration. The length of the bristles 12*a* (straight bristles) of the brush 12 is set to 2 mm to 5 mm from the standpoint of stabler contact with the photosensitive body 1.

The bristles 12*a* of the brush 12 are such that a conductive carbon powder or metal powder is dispersed as a resistance adjusting agent in resin fibers of rayon or nylon. In order to secure a better charging property, the bristles 12*a* are preferably configured to have a fiber diameter of 10 $\mu$m, an electrical resistance of about $10^5$ Ωcm and a density of about 15000 fibers/$cm^2$.

The distance L1 (see FIG. 1) between the center of the charging brush roller 2 and the image information light 4*a* is set to be below ½ the outer diameter of the charging brush roller 2 to achieve a smaller size. Further, the charging brush roller 2, contacting the photosensitive body 1, preferably has a push-in amount of 0.2 mm to 2 mm so as to secure a better charging property.

Figure 2:
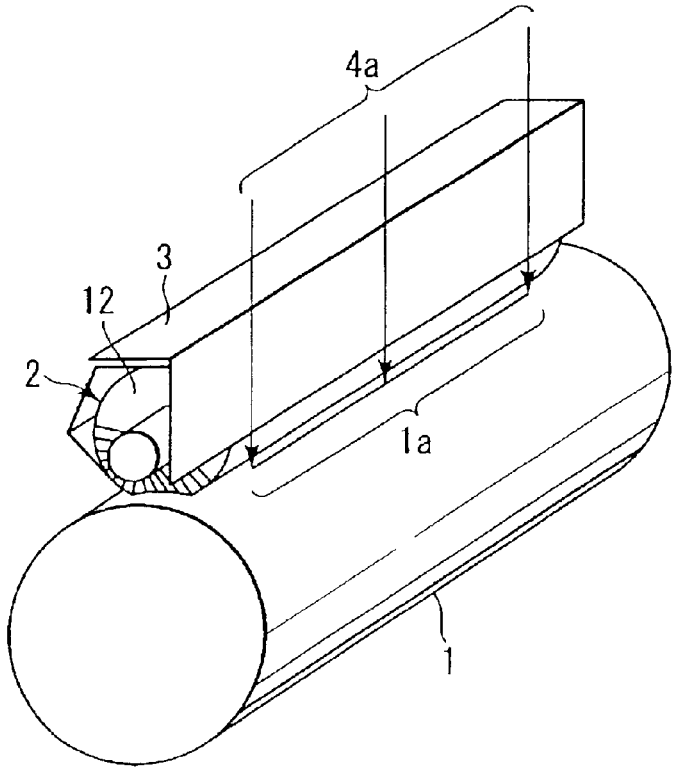
FIG. 2 is a schematic view showing a charging brush roller and guide member in FIG. 1.

On the other hand, the axial length of the charging brush roller 2 and guide member 3 is set to be longer than a light exposure area 1*a*, as shown in FIG. 2, from the standpoint of securing a stable charging property and retaining the light exposure. Further, the axial length of the guide member 3 is made greater than that of the charging brush roller 2, so that the brush 12 of the charging brush roller 2 is not caught by the edge portions of the guide member 3.

The thus structured charging brush roller 2 is so rotated that the outer periphery of the brush 12 is set in contact with the surface of the photosensitive body 1. At this time, the outer peripheral portion of the brush 12 is guided along the inner surface of the guide member 3 so as to prevent the image information light 4*a* from being blocked.

According to this embodiment, since the outer peripheral portion of the brush 12 is guided by the guide member 3 so as to prevent the image information light 4*a* from being blocked by the outer peripheral portion of the brush 12 of the charging brush roller 2, the length L1 between the center of the charging brush roller 2 and the image information light 4*a* can be made smaller than one half the outer diameter of the charging brush roller 2. It is, therefore, possible to make the resultant apparatus compact while maintaining a better charging property.

Figure 4:
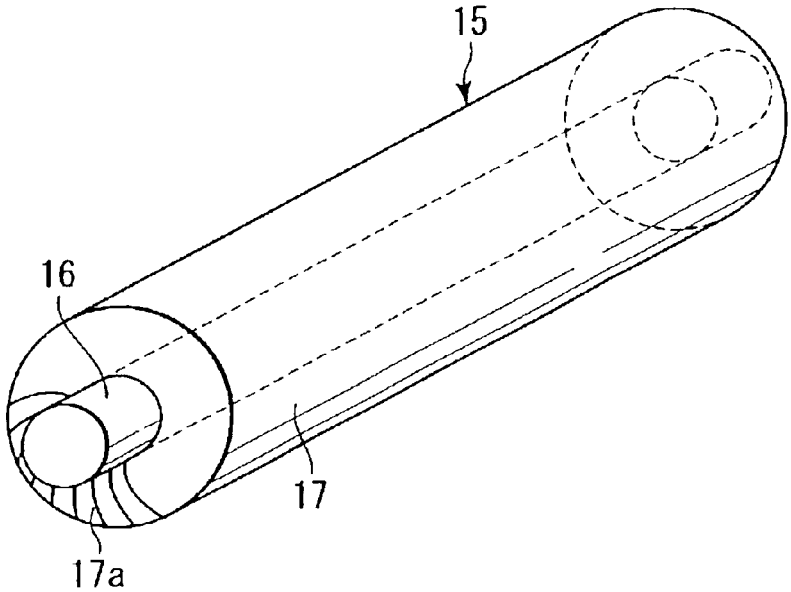
FIG. 4 is a perspective view showing a charging brush roller in a second embodiment of the present invention.
Figure 5:
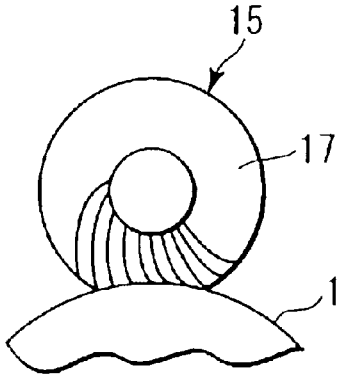
FIG. 5 is a view showing a state in which the charging brush roller of FIG. 4 is set in contact with a photosensitive body.

FIGS. 4 and 5 show a second embodiment of the present invention. In this embodiment, a charging brush roller 15 comprises a shaft 16 and a brush 17. The bristles of the brush are formed as oblique bristles 17*a*.

In the charging brush roller 2 of the first embodiment, the bristles 12*a* of the brush 12 are made as the straight bristles and only their forward end portions contact the guide member 3 and photosensitive body 1. If such contact is done over a prolonged period, there is a danger that these bristles will collapse.

In the second embodiment shown in FIGS. 4 and 5, the bristles of the brush 17 are formed as obliquely oriented bristles 17*a*. Since the oblique bristles 17*a* contact with the guide member 3 and photosensitive body 1 more in a somewhat lying posture than the straight bristles 12*a*, they produce less stress and more elasticity than the straight bristles, so there arises less collapse.

According to this embodiment, the oblique bristles 17*a* are adopted as the bristles of the charging brush roller 15 and, even if the charging brush roller 15 contacts with the guide member 3 and photosensitive body 1 over a longer period, it is possible to prevent collapse of the bristles and ensure stabler charging.

Figure 6:
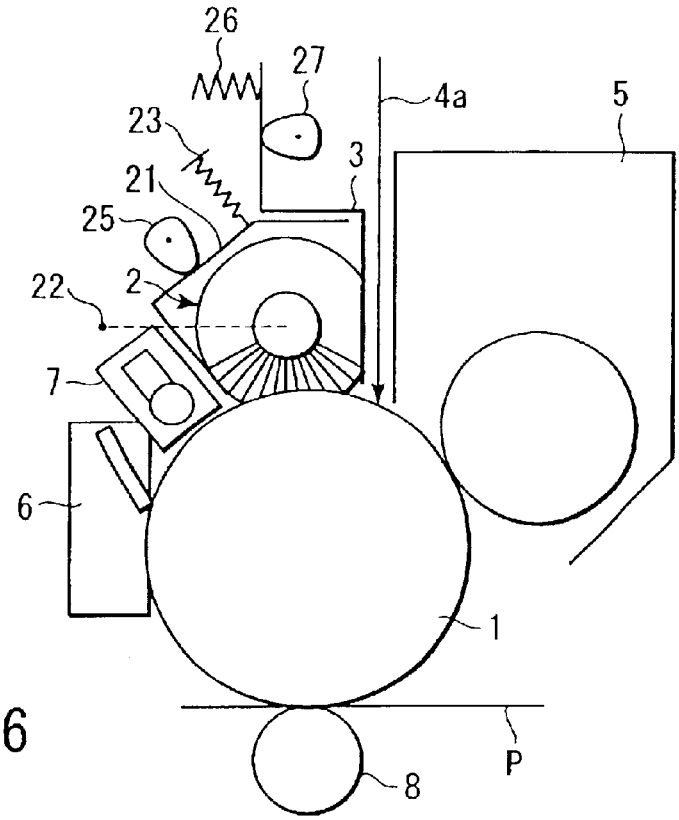
FIG. 6 is an inner schematic view showing an electrophotographic copying machine according to a third embodiment of the present invention.
Figure 7:
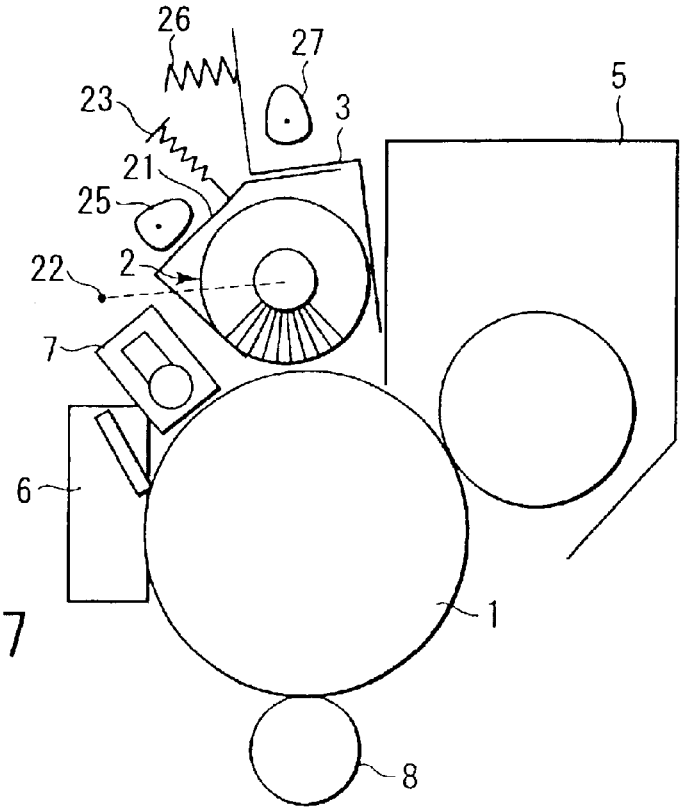
FIG. 7 is a view showing a state in which a charging brush roller of FIG. 6 is spaced apart from a photosensitive body and guide member.

FIGS. 6 and 7 shows a third embodiment of the present invention. It is to be noted that the same reference numerals are employed to designate parts or elements corresponding to those shown in the embodiment above and further explanation of them is, therefore, omitted.

In this embodiment, when an image formation operation is not performed, a charging brush roller 2 is set in a non-contact relationship to a guide roller 3 and photosensitive body 1.

In this embodiment, the charging brush roller 2 is mounted on a bracket 21. The bracket 21 is so mounted as to be rotatable about a support point 22 and so urged by a tension spring 23 as to be rotated in a counterclockwise direction. The bracket 21 is so urged as to be downwardly swung against an urging force of the tension spring 23 by the clockwise rotation of a first cam 25.

Further, the guide member 3 is slidably mounted on the bracket 21 and is urged by a compression spring 26 in a direction away from the charging brush roller 2. Further, the guide member 3 is moved against an urging force of the compression spring 26 by a counterclockwise rotation of a second cam 27 and set in contact with the charging brush roller 2.

At image forming operation time, as shown in FIG. 6, the first cam 25 is rotated in a clockwise direction to cause the bracket 21 to be pressed down against an urging force of the tension spring 23. By doing so, the charging brush roller 2 is set in contact with the photosensitive body 1. Then, the second cam 27 is rotated in a counterclockwise direction to allow the guide member 3 to be moved, in a sliding fashion, against an urging force of the compression spring 26. By doing so, the guide member 3 is set in contact with the charging brush roller 2. From this state, a predetermined image is formed on a sheet P in the same process as set out in connection with the first embodiment.

After the image forming operation is completed, as shown in FIG. 7, the first cam 25 is rotated in a counterclockwise direction. By doing so, the bracket 21 is lifted up by the tension spring 23 to allow the charging brush roller 2 to be moved away from the photosensitive body 10. Further, the second cam 27 is rotated in the clockwise direction and the guide member 3 is pushed out under an urging force of the compression spring 26 and moved away from the charging brush roller 2.

According to this embodiment, in a state in which the image is not formed, the guide member 3 and photosensitive body 1 are not set in contact with the charging brush roller 2 and it is possible to prevent the bristles of the charging brush roller 2 from being collapsed and ensure stable charging.

Figure 8:
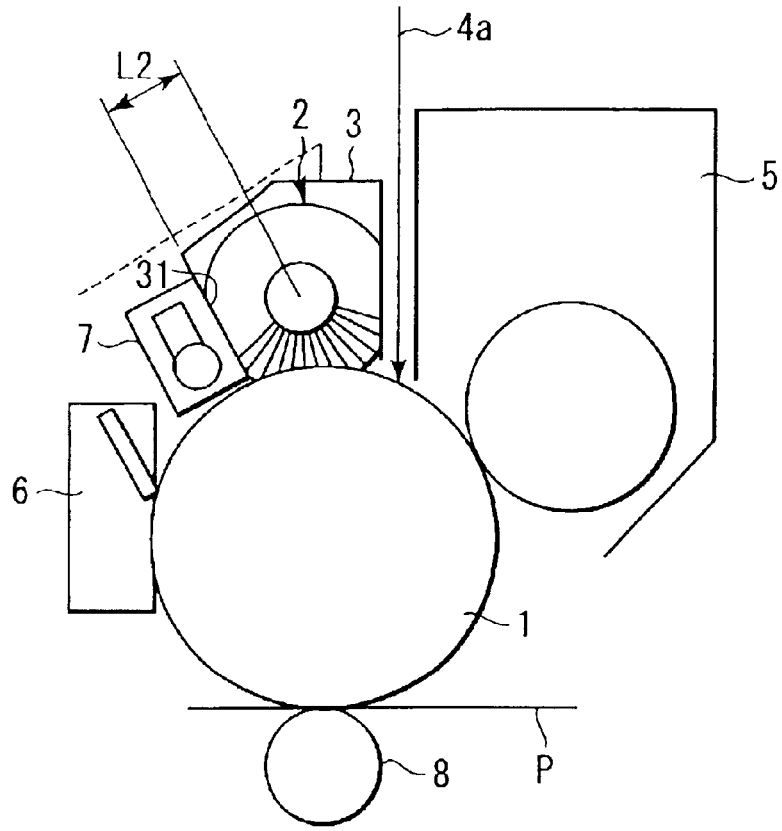
FIG. 8 is an inner schematic view showing an electrophotographic copying machine according to a fourth embodiment of the present invention.
Figure 9:
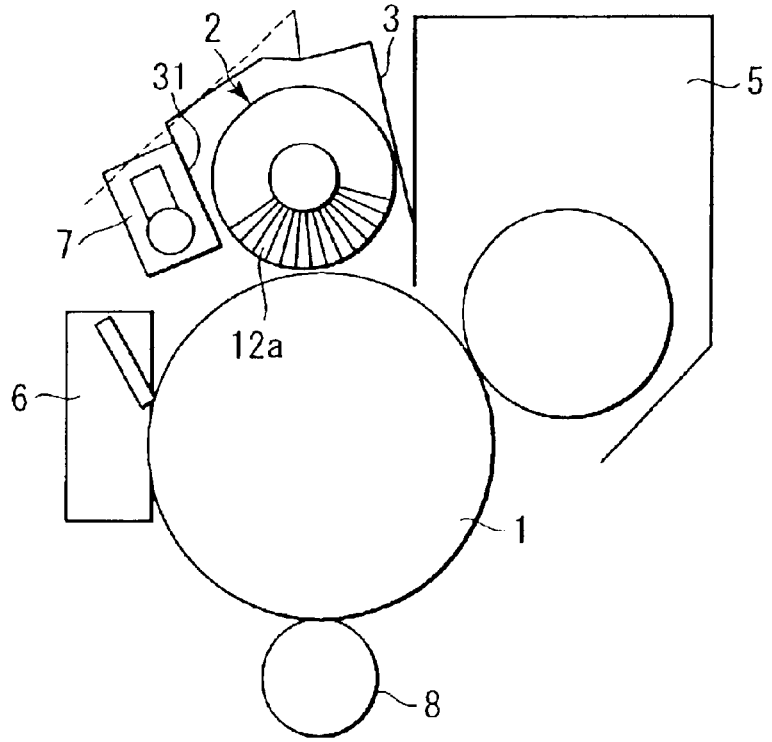
FIG. 9 is a view showing a state in which a charging brush roller in FIG. 8 is spaced away from a photosensitive body and guide member.

FIGS. 8 and 9 show a fourth embodiment of the present invention. In this embodiment, a charge eliminator 7 is set to a position where it is put in a contacting relationship to the charging brush roller 2. Here, in order to prevent the charge eliminator 7 and charging brush roller 2 from directly contacting, a protective member 31 is provided.

The protective member 31 is used to prevent short-circuiting with the charge eliminator 7 and may be formed either separate from or integral with the charge eliminator 7. The protective member 31, like the guide member 3, is formed of a metal plate, such as a steel plate, SUS and aluminum, or a resin, such as ABS and polyethylene. In the case where the protective member 31 is formed of the metal plate, an insulating surface treatment may be applied to that surface of contact with the charging brush roller 2. Further, in order to prevent toner from being deposited on that surface of the protective member 31 which contacts the charging brush roller 2, for example, a Teflon sheet of a better separation property may be bonded to or coated on that contact surface.

In order to obtain a compact unit, the distance L2 between the center of the charging brush roller 2 and the protective member 31 is set to below one half the outer diameter of the charging brush roller 2, that is, to a position where the charging brush roller 2 and protective member 31 are set in contact with each other. The push-in amount of the charging brush roller 2 relative to the protective member 31 is set to be preferably 0 to 2 mm, here, 1 mm.

It is to be noted that, if the outer wall of the charge eliminator 7 can withstand its contact with the charging brush roller 2, a direct contact structure may be adopted.

Further, the longitudinal length of the protective member 31 is set to be greater than the axial length of the charge eliminator 7 and charging brush roller 2. In the case where the length of the protective member 31 is shorter than the charge eliminator 7, an unprotected area is left there and, in the case where the protective member 31 is shorter than the charging brush roller 2, there is sometimes a case where the bristles 12*a* of the brush 12 will be caught by the edge portions of the protective member 31.

According to the present embodiment, the charge eliminator 7 and charging brush roller 2 can be combined into a compact unit relative to the circumferential portion of the photosensitive body 1, and it is possible to obtain a more compact unit.

In the present embodiment, the charging brush roller 2 is so provided as to be moved toward and away from the photosensitive body 1, and, also, the protective member 31 and guide member 3 are so arranged as to be moved toward or away from the charging brush roller 2.

When an image formation operation is not performed, as shown in FIG. 9, the charging brush roller 2 is moved upwardly away from the photosensitive body 1, and, also, the guide member 3 and protective member 31 are outwardly spread away from the charging brush roller 2.

According to the present embodiment, the photo-sensitive body 1, guide member 3 and protective member 31 are not put in contact with the charging brush roller 2 over an extended period and it is possible to prevent the bristles of the charging brush roller 2 from being collapsed and ensure stable charging.

Figure 10:
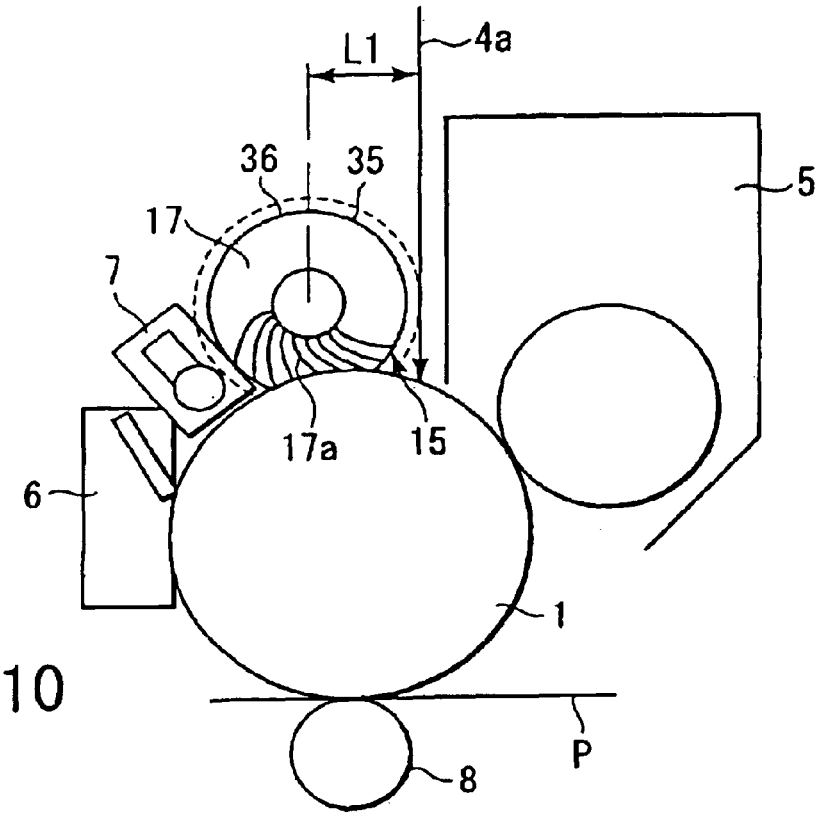
FIG. 10 is an inner schematic view showing an electrophotographic copying machine according to a fifth embodiment of the present invention.
Figure 11:
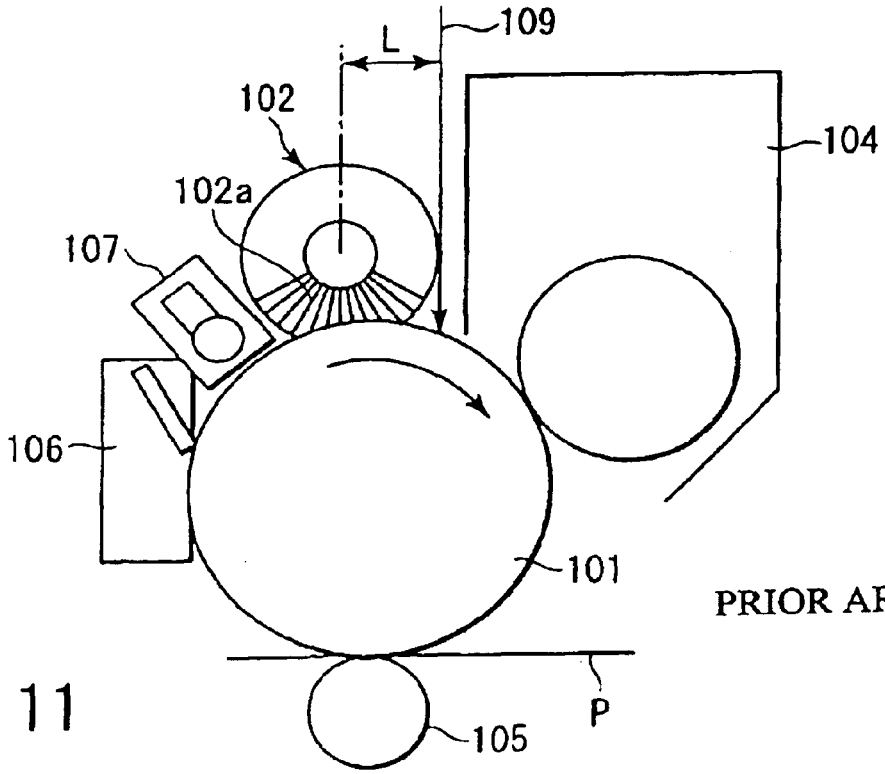
PRIOR ART FIG. 11
FIG. 11 is an inner schematic view showing a conventional electrophotographic copying machine.

FIG. 10 shows a fifth embodiment of the present invention.

In this embodiment, oblique bristles 17*a* are used for a brush 12 of a charging brush roller 2 and the distance L1 between the center of the charging roller 2 and image information light 4*a* is set more away from one half the outer diameter of the charging brush roller.

In the case where the oblique bristles 17 are used for the brush 12, it follows that, when the charging brush roller 2 is rotated, these oblique bristles are outwardly extended under centrifugal force of the brush roller 2 as indicated by a dotted line. In the case where the distance L1 is set to be ½ the outer diameter of the charging brush roller 2, the image information light 4*a* may be blocked and there is a danger that there arises poor light exposure.

In the embodiment, a circular arc-like guide member 35 is provided along an outer peripheral portion of the oblique bristles 17*a* of the charging brush roller 2. By doing so, even if the brush roller 2 is rotated, the oblique bristles 17*a* of the brush 12 are not extended outwardly and, to this extent, the brush roller 2 can be moved near the image information light 4*a* to make the distance L1 smaller and a resultant unit compact.

In the embodiment, a charge eliminator 7 is arranged near the brush roller 2 and a protective member 36 of the charge eliminator 7 is formed in a circular arc-like fashion along the outer peripheral portion of the oblique bristles 17*a* of the brush roller 2. Although the guide member 35 and protective member 36 are formed integrally with each other, these members may be formed separately from each other.

The present invention is not restricted to the above-mentioned embodiments and various changes or modifications of the invention can be made within the spirit and scope of the present invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a charging device configured to, by allowing a brush roller to be rotated in such a state as to be set in contact with a surface of an image carrier, charge the surface of the image carrier;

a light exposure device configured to radiate image information light onto the surface of the image carrier which is charged by the charging device and form an electrostatic latent image;

a developing device configured to develop the electrostatic latent image formed by the light exposure device into a developing agent image;

a transfer device configured to transfer the developing agent image developed by the developing device to a to-be-transferred medium; and a guide device configured to guide an outer periphery of the brush roller so as to prevent the image information light which is directed toward the image carrier from being blocked by the brush roller of the charging device.

2. An image forming apparatus according to claim 1, wherein a distance from the center of the brush roller of the charging device to the image information light is set to be below ½ the outer diameter size of the brush roller.

3. An image forming apparatus according to claim 1, wherein a length dimension of the guide device along an axial direction of the image carrier is set to be longer than an axial length dimension of the brush roller.

4. An image forming apparatus according to claim 1, wherein the brush roller of the charging device is configured to have a brush comprising a shaft and bristles formed on the shaft, the bristles comprising oblique bristles oriented in one direction.

5. An image forming apparatus according to claim 4, wherein the bristles comprise a conductive fiber-formed cloth.

6. An image forming apparatus according to claim 1, wherein the guide device is made of a metal material or a resin material.

7. An image forming apparatus according to claim 6, wherein a surface of the metal material which contacts the brush roller is insulation-treated.

8. An image forming apparatus comprising:

a charging device configured to, by allowing a brush roller to be rotated in such a state as to be set in contact with a surface of an image carrier, charge the surface of the image carrier;

a light exposure device configured to radiate image information light onto the surface of the image carrier charged by the charging device and, by doing so, form an electrostatic latent image;

a developing device configured to develop the electrostatic latent image which is formed by the light exposure device into a developing agent image;

a transfer device configured to transfer the developing agent image which is developed by the developing device to a to-be-transferred medium;

a guide device configured to guide an outer periphery of the brush roller so as to prevent the image information light which is radiated toward the image carrier from being blocked by the brush roller of the charging device; and a moving device configured to move the brush roller of the charging device toward and away from the guide device and image carrier.

9. An image forming apparatus comprising:

a charging device configured to, by allowing a brush roller to be rotated in such a state as to be set in contact with a surface of an image carrier, charge the surface of the image carrier;

a light exposure device configured to radiate image information light onto the surface of the image carrier charged by the charging device and, by doing so, form an electrostatic latent image;

a developing device configured to develop the electrostatic latent image formed by the light exposure device into a developing agent image;

a transfer device configured to transfer the developing agent image which is developed by the developing device onto a to-be-transferred medium;

a charge eliminating device configured to, after the developing agent image has been transferred to the medium by the transfer device, discharge the surface of the image carrier, the charge eliminating device being set in a position contacting the brush roller of the charging device; and a guide device configured to guide an outer periphery of the brush roller so as to prevent the image information light which is radiated from the light exposure device from being blocked by the brush roller of the charging device.

10. An image forming apparatus according to claim 9, further comprising a protective member provided between the charge eliminating device and the brush roller to prevent direct contact between the charge eliminating device and the brush roller.

11. An image forming apparatus according to claim 10, wherein a contact area between the protective member and the brush roller at least electrically insulates the protective member from the brush roller.

* * * * *